United States Patent [19]

Oswald

[11] Patent Number: 4,800,697

[45] Date of Patent: Jan. 31, 1989

[54] MODULAR INTERSTITIAL CONCRETE SUB-FLOOR

[76] Inventor: Arthur A. Oswald, Steinstrasse 58, 8003 Zurich, Switzerland

[21] Appl. No.: 41,453

[22] Filed: Apr. 23, 1987

[51] Int. Cl.[4] ..... E04C 1/00

[52] U.S. Cl. ..... 52/309.17; 52/447; 52/450; 52/630; 428/117

[58] Field of Search ..... 52/443, 447, 450, 453, 52/309.17, 323, 336, 598, 792, 630; 428/117

[56] References Cited

U.S. PATENT DOCUMENTS

| | | | |
|---|---|---|---|
| 2,089,893 | 8/1937 | Grenlich | 52/447 X |
| 3,086,899 | 4/1963 | Smith et al. | 52/630 X |
| 3,501,878 | 3/1970 | Segal | 52/792 X |
| 3,775,240 | 11/1973 | Harvey | 52/309.17 X |

*Primary Examiner*—Carl D. Friedman

*Attorney, Agent, or Firm*—Keith D. Beecher

[57] ABSTRACT

An interstitial sub-floor formed of concrete contained in a prefabricated formwork composed of a plurality of rigid plastic eggcrate-type modules positioned adjacent to one another and bonded to one another.

2 Claims, 1 Drawing Sheet

MODULAR INTERSTITIAL CONCRETE SUB-FLOOR

BACKGROUND OF THE INVENTION

As modern offices, laboratories, work shops, etc. require more and more sophisticated electronic equipment, easy and flexible access to electrical wiring and data and communication cables becomes increasingly important. An object of this invention is to provide a modular interstitial concrete sub-floor which is constructed so that such access is available at all times and anywhere on the floor of the work area, and to achieve this at a price lower than that of existing systems.

The invention comprises a modular interstitial concrete sub-floor which includes a molded floor covering which is mounted on a regular concrete floor to create cavities which serve as cable ducts. The floor covering forms a blind shell or formwork for an upper floor layer of concrete. The blind shell is set in sheets of desired square or rectangular size on the floor at the time of construction of the building or a renovation. It is shaped of rigid hollow pyramidal trunks protruding from a reinforced frame, thus providing an interconnected system of cavities. The side panels of the pyramidal trunks have a prefered angle of 60° to 75°.

The interstitial concrete sub-floor of the present invention is supported on a framework which is similar in some respects to the bearing sheet described in Swiss Patent No. CH654 059 A5. However, the blind shell of the sub-floor of the present invention involves the use of simple rigid plastic, aluminum, hard foam, or the like, egg-crate like modules, which are bonded together in a uni-planar relationship to provide the formwork for the concrete, as compared with the flexible bearing sheets disclosed in the Swiss patent which, as described in the patent require reinforcement and are somewhat awkward to use.

The interstitial sub-floor of the invention serves the same general purpose as the flooring described in Wiesman, U.S. Pat. No. 2,259,674, which uses corrugated metal sheets under concrete to provide wiring conduits extending across the floor in one direction only. The sub-floor of the present invention is advantageous, however, it is easy to set up, is economical to produce, and in that it provides a grid of ducts and conduits extending in mutually perpendicular directions under the subfloor. The ducts are accessible at any time for electrical, telephone and other leads and cables. Accordingly, sockets and junction boxes may be mounted in each room as required and at any desired positions. Moreover, cable installations from room-to-room may be easily effectuated, whenever desired.

The interstitial sub-floor of the invention is also advantageous in that it exhibits relatively high compression strength and bending tension, as well as Brinell hardness, as compared with conventional sub-floors. The smooth surface of the interstitial sub floor of the invention is free from expansion joints and raised corners, or other deformations, and it is ideally suited for the laying of the usual floor coverings.

The interstitial sub-floor of the invention is useful not only in the construction of new buildings, but in the renovation of old buildings. The rigid nature of the plastic modular framework included in the sub-floor of the invention facilitates the pouring of the concrete, and the formation of the concrete layer of the sub-floor assembly.

DETAILED DESCRIPTION OF THE ILLUSTRATED EMBODIMENT

Figure 1:
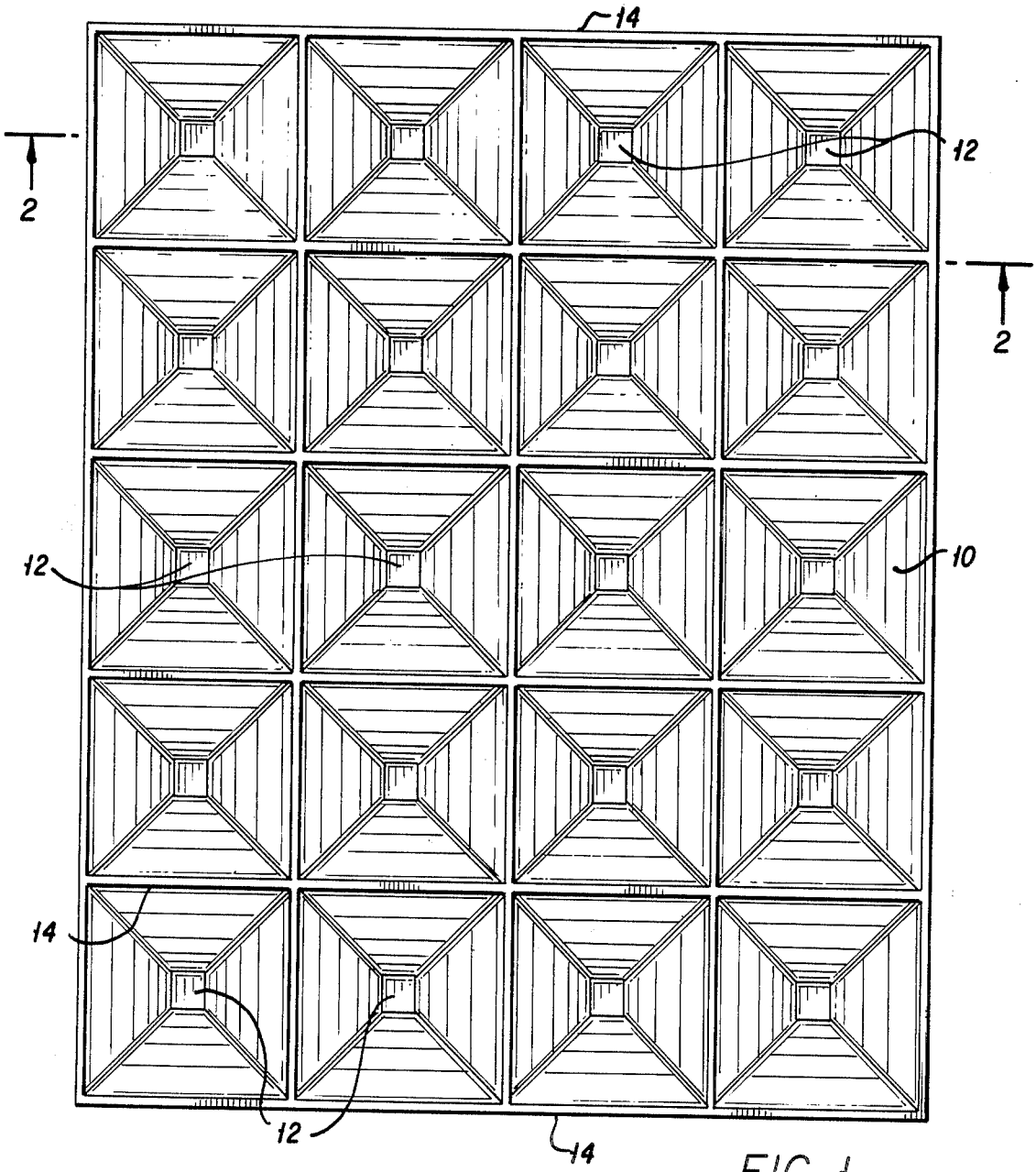
FIG. 1 is a bottom view of a rigid plastic module which provides a blind shell or formwork for the concrete portion of the sub-floor of the invention.
Figure 2:
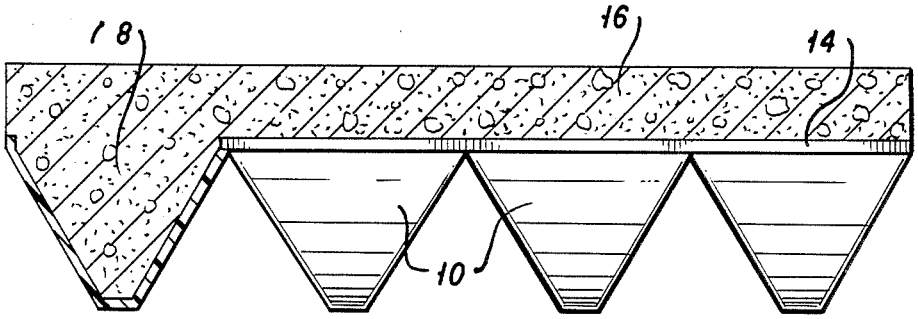
FIG. 2 is a section taken along the lines 2—2 of FIG. 1, and also showing a section of the concrete portion of the floor which is supported by the module.

The module shown in FIGS. 1 and 2 is designated 10 and, as shown, it has an egg-crate configuration to provide a plurality of pockets each having a truncated pyramidal shape, so as to provide a multiplicity of bearing surfaces 12 which engage the supporting surface of the sub-floor. The module 10, as stated above, is formed of an appropriate rigid material, such as polystyrene, and the module is formed as an integral structure by a usual molding operation.

Specifically, the blind shell module can be made of plastic, one of a number of polymers suitable for deep-drawing, or injectible with an injection-molding machine. It should be 1.5 to 3 mm or 0.059 to 0.118 inches deep (thick). When filled with concrete and supporting a top layer of concrete which becomes the actual floor, it should withstand concentrated loads of up to 1000–1500 lbs. per square foot which is sufficient for rooms where computers and other heavy machinery will be used. The blind shell can also be molded of aluminum and its alloys, of molded hard form (like styrofoam). The pyramidal trunks of the shell can vary in height to allow for the space needed to accommodate all the cables and wires to be used on a given floor.

A typical size of the module 10 is 2 feet by 2½ feet; the bearing surfaces 12 have a square shape, and may, for example, be 1½ inches by 1½ inches; and each pocket may have a square configuration and may measure ½ foot by ½ foot; the depth of the pockets may be 4 inches, and each module has a rim 14 which may have a height of, for example, ½ inch. These dimensions are given merely by way of illustration and are not intended to limit the invention in any way.

In the construction of the sub-floor, a plurality of modules such as the module 10 of FIGS. 1 and 2 are layed adjacent to one another on a supporting surface, and are bonded to one another by any appropriate manner, such as by plastic welding. Concrete is then poured into the framework, to form a layer of concrete 16, as shown in FIG. 2, with the concrete flowing into the individual pockets.

The blind shell module is secured to the bottom floor by stapling or glueing the flat square top of the pyramid upside down to the floor. Each sheet has overlaps which are glued or taped on top of each other to seal the blind shell covering completely before the top layer of concrete is poured. The blind shell can be filled with concrete and anhydrite mixtures without running the risk that it will collapse. The shell will also support the weight of planks and workmen as they proceed with the pouring of the material. As soon as the material has hardened, the floor is ready for traffic and full weight bearing. Partitions can then be erected.

The resulting interstitial sub-floor, as described above, is advantageous in that it provides a grid of ducts and conduits extending in mutually perpendicular directions under the sub-floor. These conduits are accessible at any time for electrical, telephone and other leads and cables. The rigid nature of the formwork provided by the rigid modules 10, facilitates the pouring of the concrete 16 into the framework to form a smooth and level sub-floor.

For example, from a central electrical junction box or channel, wired to the building services, the different cables can be led through the cavities in all directions. Cables can be pushed in one direction a distance up to 20 feet without difficulty. Where access is required, a hole can be drilled through the concrete floor and shell, just large enough to hold a junction box or socket in a utility grommet, about 3½" to 5" in diameter, with a lid. When work areas are changed in size, partitions moved, etc. and the access is no longer desired at a particular spot, the grommet can be removed and the hole sealed with plastic or aluminum and filled with concrete. Therefore, access can be gained or terminated anywhere at any time.

It will be appreciated that while a particular embodiment of the invention has been shown and described, modifications may be made. It is intended in the claims to cover all modifications which come within the true spirit and scope of the invention.

I claim:

1. An interstitial sub-floor comprising: a formwork composed of a plurality of rectangular modules attached to one another, each of said modules having an egg-crate configuration and formed of an integral rigid material, each of said modules providing a multiplicity of pockets, and each of said pockets being formed as a truncated pyramid having a rectangular base with rims directly adjacent to and integral with the rims of the adjacent pockets, and having an apex forming a bearing surface; and a concrete layer contained in said pockets and supported by said formwork.

2. The interstitial sub-floor defined in claim 1, in which each of said modules is formed of a molded plastic material.

* * * * *